US006262800B1

(12) United States Patent
Minor

(10) Patent No.: US 6,262,800 B1
(45) Date of Patent: Jul. 17, 2001

(54) DUAL MODE SEMI-ACTIVE LASER/LASER RADAR SEEKER

(75) Inventor: Lewis G. Minor, Arlington, TX (US)

(73) Assignee: Lockheed Martin Corporation, Bathesda, MD (US)

( * ) Notice: Subject to any disclaimer, the term of this patent is extended or adjusted under 35 U.S.C. 154(b) by 0 days.

(21) Appl. No.: 09/263,411

(22) Filed: Mar. 5, 1999

(51) Int. Cl.[7] ..... G01B 11/26; G01C 3/08; G01C 21/02; F41G 7/00

(52) U.S. Cl. ..... 356/139.07; 244/3.13; 244/3.16; 356/5.01; 356/5.1; 250/342; 250/203.2

(58) Field of Search ..... 356/141.1, 4.01–5.15, 356/139.01–139.08; 244/3.16; 250/342, 203.2, 203.3, 203.1

(56) References Cited

U.S. PATENT DOCUMENTS

| | | | | |
|---|---|---|---|---|
| 3,899,145 | * | 8/1975 | Stephenson | 244/3.16 |
| 4,085,910 | | 4/1978 | Baker et al. | 244/3.16 |
| 4,264,907 | * | 4/1981 | Durand et al. | 244/3.16 |
| 4,326,799 | * | 4/1982 | Keene et al. . | |
| 4,383,663 | * | 5/1983 | Nichols | 244/3.16 |
| 4,497,065 | * | 1/1985 | Tisdale et al. . | |
| 4,737,028 | * | 4/1988 | Smith . | |
| 4,776,274 | | 10/1988 | Kriz et al. | 102/213 |
| 5,528,354 | * | 6/1996 | Uwira | 356/5.01 |
| 5,600,434 | * | 2/1997 | Warm et al. | 356/139.08 |
| 5,681,009 | * | 10/1997 | Vandersteen et al. | 244/3.16 |
| 5,991,033 | * | 11/1999 | Henshaw et al. . | |

FOREIGN PATENT DOCUMENTS

| | | |
|---|---|---|
| 36 15 266 | 11/1987 | (DE) . |
| 0 102 466 | 3/1984 | (EP) . |

* cited by examiner

*Primary Examiner*—Stephen C. Buczinski
(74) *Attorney, Agent, or Firm*—Williams, Morgan & Amerson, P.C.

(57) ABSTRACT

The invention provides a method and apparatus for guiding a weapon to a target using an optical seeker having dual semi-active laser (SAL) and laser radar (LADAR) modes of operation. The dual mode seeker incorporates a laser light source, an optical package including a quadrant detector for operating in SAL mode and a LADAR receiver for operating in LADAR mode. The seeker further includes a high speed scanning mirror for switching between modes to guide the weapon to the target. The method for guiding a weapon to a target includes receiving radiation from the target and tracking the radiation to guide the weapon; monitoring the detected radiation such that if the radiation falls below a predetermined level, a laser system on-board the weapon continues guiding the weapon by generating a laser beam; reflecting the laser beam off the target so that the reflected laser radiation is received from the target to track the radiation and guide the weapon to the target.

50 Claims, 6 Drawing Sheets

DUAL MODE SEMI-ACTIVE LASER/LASER RADAR SEEKER

1. BACKGROUND OF THE INVENTION

1.1 Field of the Invention

The present invention relates to an optical guidance system and more particularly to a seeker system having dual semi-active laser and laser radar modes of operation.

1.2 Description of Related Art

Laser energy is uniquely suited to perform many specialized functions because of its coherent, extremely stable, frequency characteristics, thus making possible the generation and transmission of very well defined and characterized beams of energy. Since the development of practical laser apparatus, such apparatus are finding many applications for locating and identifying remote objects including, in military operations, target marking and guidance systems.

One of the present marking and guidance systems is the semi-active laser (SAL) system. SAL systems have been used by military aircraft to support ground operations. With the SAL system, a narrow laser beam is produced and transmitted toward a target. The laser radiation is typically generated and transmitted from a laser designator aircraft manned by a forward operator. The operator directs the laser radiation to a selected target, thereby designating the target.

The laser radiation reflected from the target can then be detected by the laser seeker head of a missile or other weapon located remote from both the target and the laser energy transmitter. The SAL system includes processing equipment for generating guidance commands to the missile derived from the sensed laser radiation as it is reflected from the target. Such a system can be used by pilots or other users to identify a target and guide the missile or weapon to the target.

Although these systems have proven effective, the next generation missiles are expected to fly to ranges well beyond the range of imaging sensors on board the designator platform. On the other hand, there are many SAL designators already in the field with proven records of extremely high weapon accuracy and positive control.

Another known seeker guidance system is the laser detection and radar (LADAR) system. Unlike its SAL cousin, the LADAR system incorporates its own laser source, thus eliminating the need for an external designator. Typical LADAR systems are adapted to scan a target area with laser energy, detect the reflected radiation, and compute range and intensity values, permitting the processing of guidance and control signals for the weapon as it approaches the target With its specialized data processing capabilities, the LADAR system provides superior ability to acquire targets autonomously.

U.S. Pat. No. 4,085,910 ('910) discloses a dual mode optical seeker device having an infra-red and visible light sensor. The seeker of the '910 functions as a SAL seeker by sensing infra-red radiation transmitted from a designator platform and reflected from a target. The '910 seeker also includes a visible light sensor for determining the orientation of the missile relative to a visible target. Since the '910 seeker requires an external designator and relies on visible light to mark and track a target, it is limited to certain range and environmental conditions. The '910 seeker is also not adapted to rapid scanning possible with LADAR devices.

Advancement in enemy air defense systems drives the need for enhanced weapon guidance capability. It is desirable to further increase the range of modern weapons while still maintaining high accuracy and positive control. Still further, it is desired to implement these capabilities without great alteration or cost to existing weapon systems. Thus, there remains a need for a new, low cost, seeker system that offers advanced capabilities.

2. SUMMARY OF THE INVENTION

A system and method are provided for guiding a weapon to a target. In one aspect of the invention, a method comprises receiving radiation from the target; tracking and monitoring the radiation to guide the weapon to the target such that if the radiation falls below a predetermined level a laser system on-board the weapon continues guiding the weapon by generating a laser beam; reflecting the laser beam off the target; receiving laser radiation reflected from the target; and tracking the radiation to guide the weapon to the target. In a second aspect, an on-board weapon guidance system comprises a laser light source; means for detecting radiation proceeding from a target to guide the weapon to the target; and means for switching between the detection of radiation originating from a source independent of the weapon and proceeding from the target, and the detection of laser radiation originating from the laser light source and reflected from the target.

3. BRIEF DESCRIPTION OF THE DRAWINGS

Other aspects and advantages of the invention will become apparent upon reading the following detailed description and upon reference to the drawings in which.

4. DESCRIPTION OF ILLUSTRATIVE EMBODIMENTS

In the interest of clarity, not all features of actual implementation are described in this specification. It will of course be appreciated that in the development of any such actual implementation, as in any such project, numerous engineering decisions must be made to achieve the developer's specific goals and subgoals (e.g., compliance with existing systems-and-cost related constraints), which will vary from one implementation to another. Moreover, attention will necessarily be paid to proper engineering and implementation practices for the environment in question. It will be appreciated that such a development might be complex and time-consuming, but would nevertheless be a routine undertaking for those of ordinary skill in the field having the benefit of this disclosure.

Figure 1:
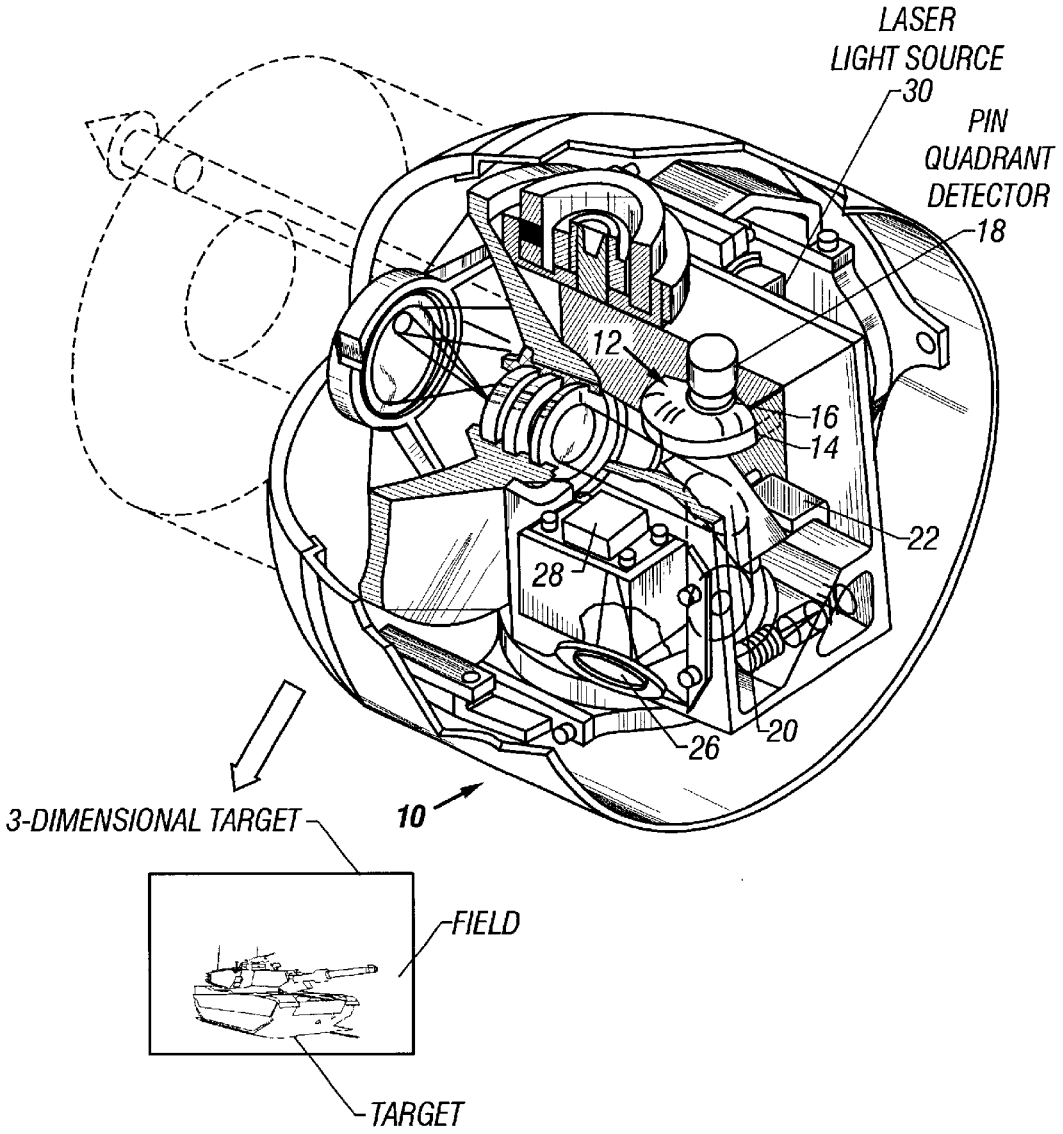
FIG. 1 is a perspective view, partially broken away and partially in section, of the dual mode seeker of the invention.

FIG. 1 illustrates a particular embodiment of the dual mode seeker 10 of the invention. The manner in which the seeker generates, transmits, and receives a LADAR scan pattern is fully disclosed and claimed in U.S. Pat. Nos. 5,200,606; 5,224,109; and 5,285,461, each of which is hereby expressly incorporated by reference for all purposes as if set forth verbatim herein. The SAL mode of the present invention is implemented with minimal addition of components to the LADAR seeker referenced above, thereby significantly reducing the cost of the dual mode system.

The seeker 10 of the invention includes a first optical assembly 12 configured to receive and detect electromagnetic radiation originating or proceeding from a source (not shown) independent and external of the seeker 10. For example, the first optical assembly 12 may receive light radiation emitted from a beacon or proceeding from a reflective surface of a vehicle or building. As discussed above, in typical SAL mode, the first optical assembly 12 generally receives laser radiation transmitted from an independent designator 275 and reflected from the target.

The first optical assembly 12 includes a receiver lens 14, a narrow band filter 16, for filtering out wavelengths of undesired light to reduce background interference, and a silicon p-intrinsic (PIN) quadrant detector 18. The seeker 10 of the invention includes a moveable high-speed scanning mirror 20 connected to a mirror shaft 21 (shown in FIG. 3). The mirror shaft 21 is pivotally driven by a torque motor 22. An angle position sensing device 24 is also included to determine the angular position of the scanning mirror 20 as it pivots about the mirror shaft 21 axis.

Figure 2:
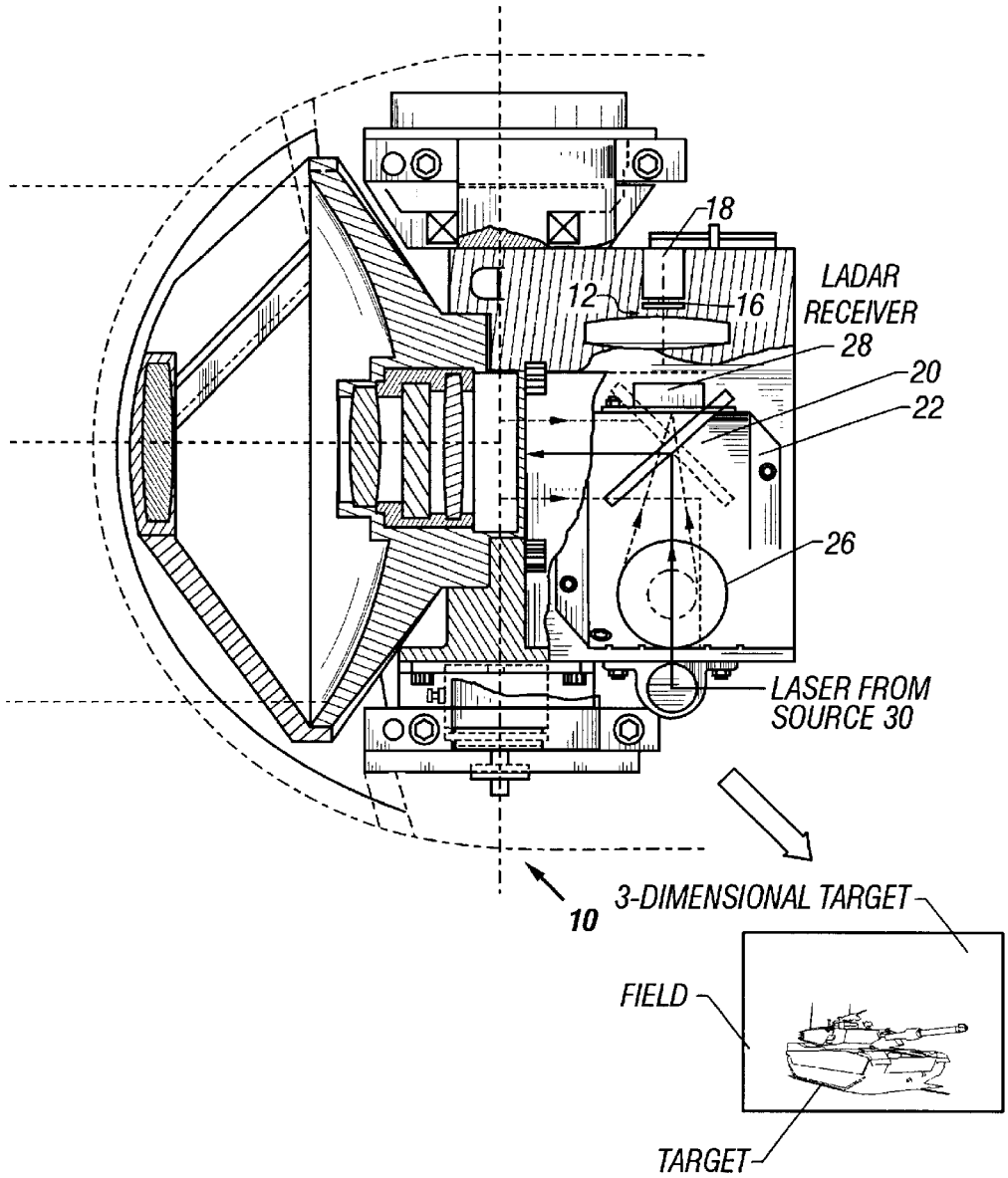
FIG. 2 is an elevation, sectional view of the seeker of FIG. 1.

FIG. 2 illustrates a second optical assembly 26 housed in the seeker 10. The second optical assembly 26 includes a LADAR receiver 28 for receiving and detecting laser radiation. The present invention also includes its own laser light source 30 (shown in FIG. 1), which emits the laser light energy employed for illuminating the target in the LADAR mode of operation.

The seeker 10 of the present invention may be used in the SAL or LADAR mode without compromising the performance of either mode. Turning to FIG. 2, the seeker 10 is shown in the LADAR mode of operation. The dashed lines in FIG. 2 represent the redirected laser radiation detected during the LADAR mode of operation.

Figure 3:
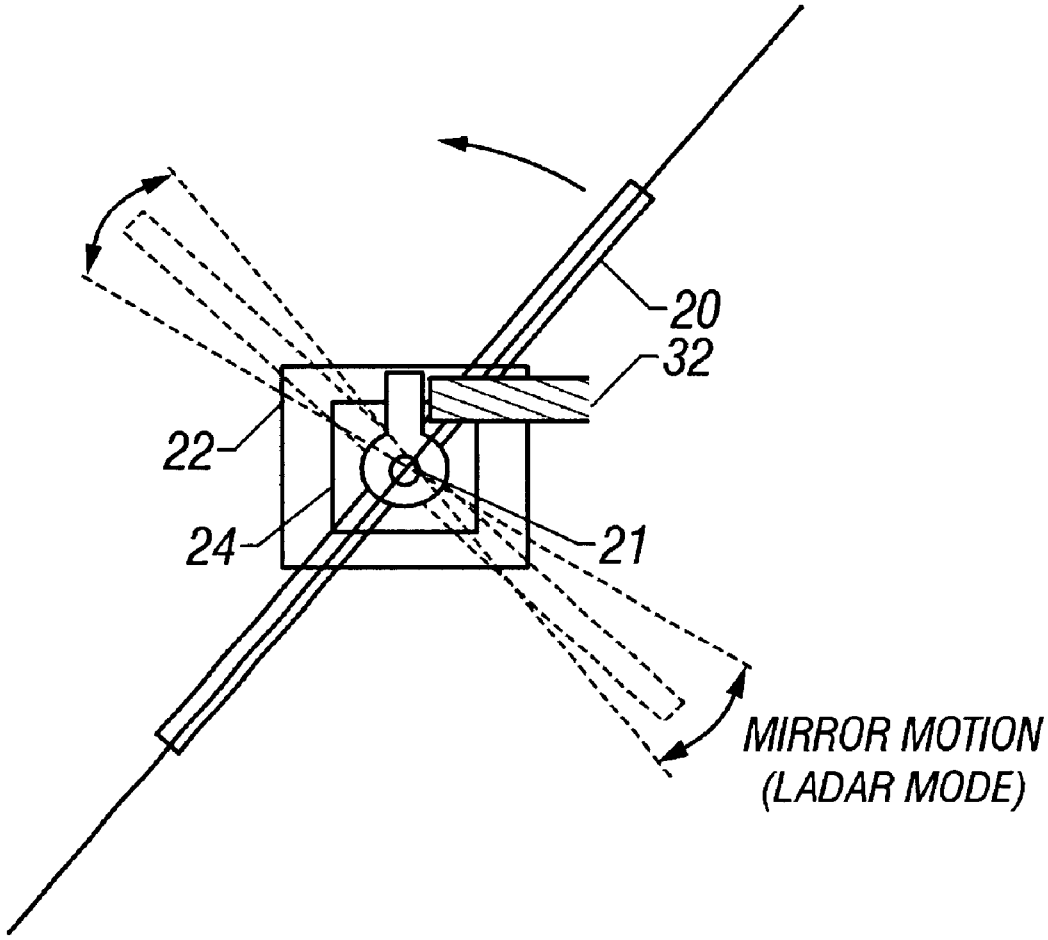
FIG. 3 is an illustration of the mirror assembly of the seeker of FIGS. 1 and 2.

In the SAL mode of operation, the torque motor 22 applies a rotating force to the mirror shaft 21, which rotates the scanning mirror 20 until the mirror 20 is held to a precise and fixed position by a mechanical stop 32 and a lever arm 33 affixed to the mirror shaft 21 (shown in FIG. 3).

Electromagnetic radiation received by the seeker 10 in SAL mode is redirected and focused unto the PIN quadrant detector 18 of the first optical assembly 12. The radiation detected by the PIN quadrant detector 18 is then converted to electrical signals and processed by a control circuit (not shown) using standard quadrant detector algorithms. Additional electronics (not shown) in the seeker 10 then use the processed signals to guide the weapon to the target. The PIN quadrant detector 18 response can also be compensated for obscurations, including linearity, by implementing a table lookup procedure in the algorithm.

As long as the electromagnetic radiation detected by the PIN quadrant detector 18 remains above a predetermined level established in the control circuit, the scanning mirror 20 continues to redirect all of the received radiation to the first optical assembly 12. If the radiation detected by the PIN quadrant detector 18 falls below the predetermined level, the control circuit automatically switches to the LADAR mode of operation to provide autonomous target acquisition as described in the referenced Letters Patent above.

In LADAR mode, the laser light source 30 emits a laser beam programmed to illuminate and scan a field for target acquisition, as described in the referenced Letters Patent. When the control circuit switches operation of the seeker 10 to LADAR mode, the torque motor 22 rotates the scanning mirror 20, through the mirror shaft 21, by 90° about the mirror shaft 21 axis (as shown by dashed lines in FIGS. 2 and 3). As the scanning mirror 20 is rotated away from the mechanical stop 32, the angle position sensing device 24 determines the mirror 20's angle about the mirror shaft 21 in order to slow the mirror 20 to a stop without damaging the mirror 20.

The angle position sensing device 24 may be one of many commercially available sensors offering various ranges of degree measurement. The angle position sensing device 24 is configured such that the sensor has sufficient range to scan to the mechanical stop 32 and also aid in performing linear, high speed scans when the seeker 10 is operating in the LADAR mode. The angle position sensing device 24 can be incorporated in various locations, including on the mirror shaft 21 or integrated into the torque motor 22, depending on space constraints or other limitations as recognized by those skilled in the art having the benefit of this disclosure.

In the LADAR mode, the laser beam emitted by the laser light source 30 is scanned by the scanning mirror 20 through an angular range of approximately 20° about the mirror shaft 21 axis to generate a high-speed scan of the target scene. As the target scene is being scanned, all the reflected laser radiation received by the seeker 10 is redirected and focused unto the LADAR receiver 28 of the second optical assembly 26, where it is processed by the control circuit to form and track a three dimensional image of the target to guide the weapon to the target.

Although the seeker 10 of the present invention cannot operate in both modes simultaneously, the switch between modes occurs nearly instantaneously, facilitating a nearly simultaneous dual mode capability. If the PIN quadrant detector 18 never receives a valid radiation pulse from the designator or independent source while in the SAL mode, the seeker 10 by default will switch to the LADAR mode and use automatic target recognition to acquire the target. Alternatively, the seeker 10 may be utilized strictly in the LADAR mode by deactivating the SAL mode before launching the weapon from the platform. In that case, the weapon would be launched toward a predetermined coordinate such that the seeker 10 autonomously acquires the target.

In an alternative implementation, the seeker 10 can be used in the LADAR mode to form and process a three dimensional image of the target which can be used to identify the target class. Thus providing a means of preventing the unintentional attack of friendly forces in military operations and enhancing the performance of the seeker 10. In hindsight, it will be appreciated by those of ordinary skill having the benefit of this disclosure that the seeker 10 system disclosed herein can be used in a variety of situations apart from military implementations.

Figure 4:
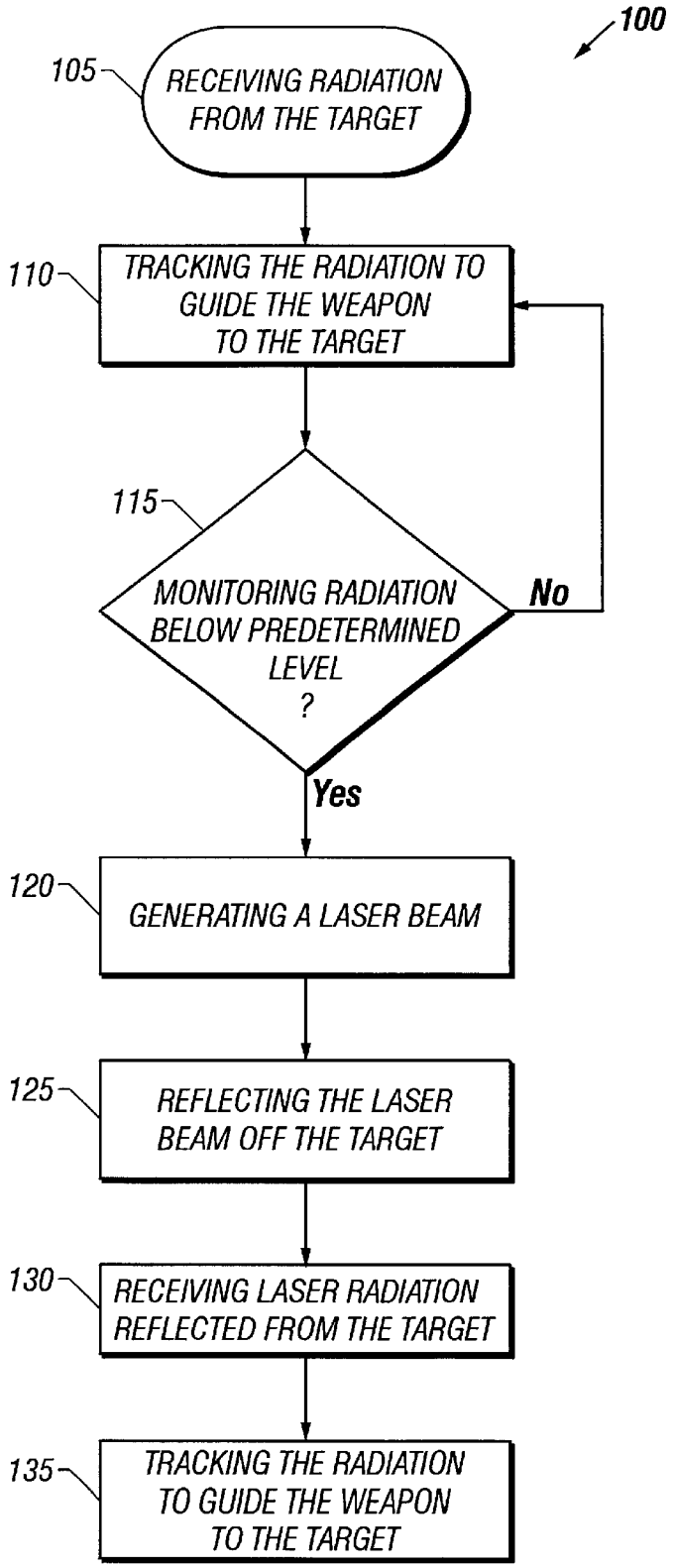
FIG. 4 is a flow chart describing operations performed in accordance with the invention.
Figure 6:
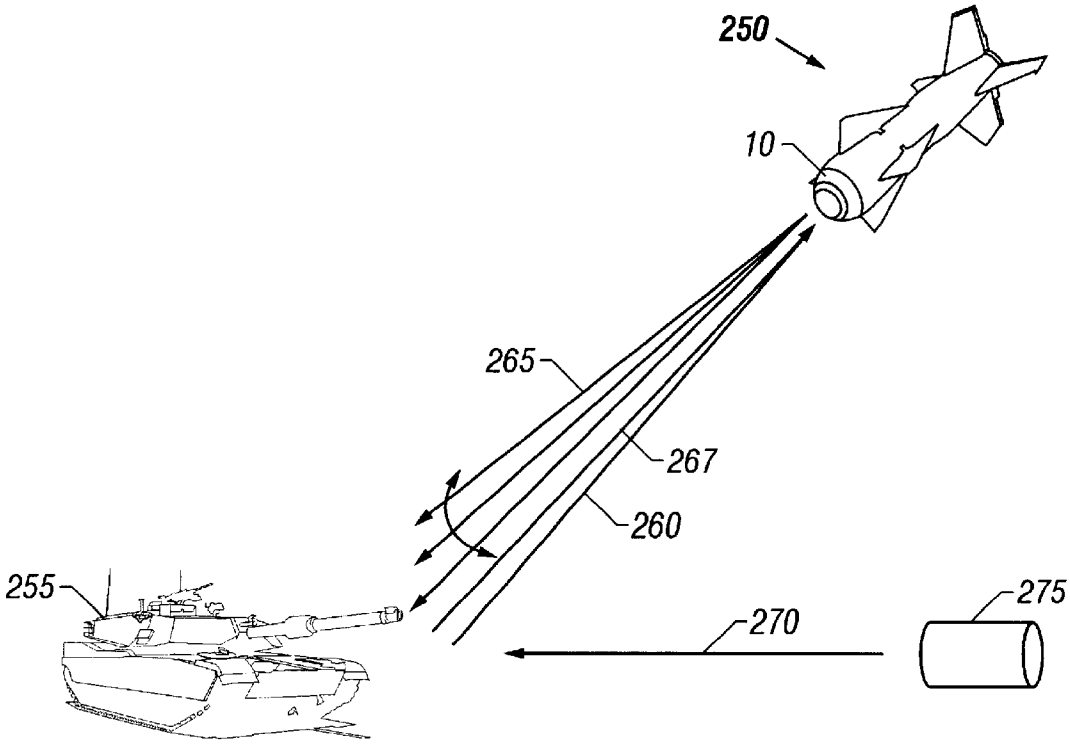
FIG. 6 depicts, in conjunction with FIG. 4 and FIG. 5, selected elements of the methods described therein.

FIG. 4 in conjunction with FIG. 6 depicts a method 100 for guiding a weapon 250 to a target 255 in accordance with the present invention. The method 100 may be executed with the seeker 10 of the present invention (or other dual mode seeker), and comprises receiving radiation 260 from the target 255, as set forth in the box 105; and tracking the radiation 260 to guide the weapon 250 to the target 255, as set forth in the box 110; the radiation 260 is monitored as set forth in the box 115 such that if the radiation 260 falls below a predetermined level, a laser system (shown in FIGS. 1–3) on-board the weapon 250 continues guiding the weapon 250 by generating a laser beam 265, as set forth in the box 120, and reflecting the laser beam 265 off the target 255, as set forth in the box 125, so that the reflected laser radiation 267 is received from the target 255 as set forth in the box 130 to track the radiation 267 and guide the weapon 250 to the target 255, as set forth in the box 135.

Figure 5:
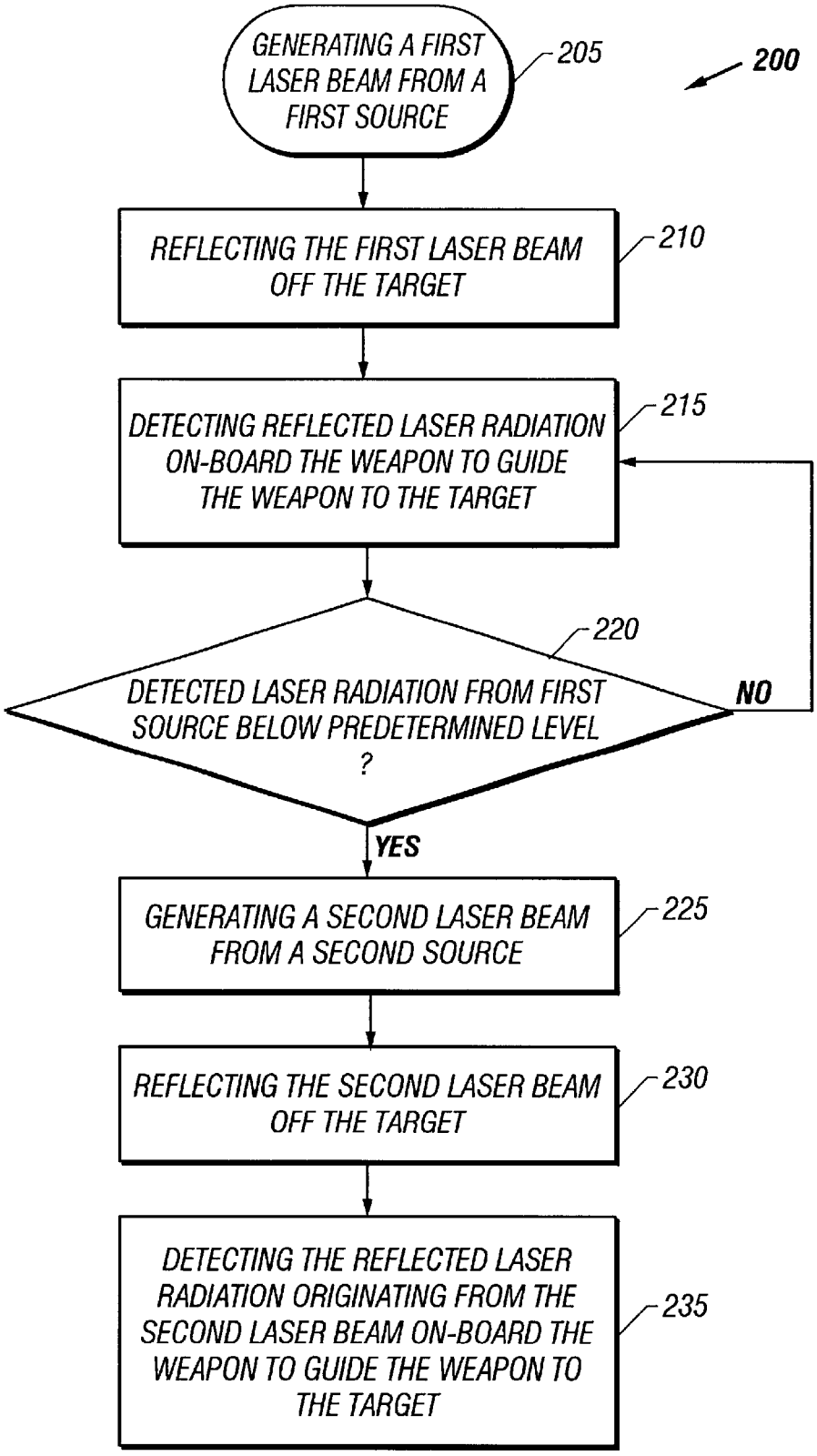
FIG. 5 is a second flow chart describing operations performed in accordance with the present invention.

FIG. 5 in conjunction with FIG. 6 depicts another method 200 for guiding a weapon 250 to a target 255 in accordance with the present invention. This method 200 may also be executed with the present dual mode seeker 10 (or other dual mode seeker). The method 200 comprises generating a first laser beam 270 from a first source 275, as set forth in the box 205, and reflecting the first laser beam 270 off the target 255, as set forth in the box 210; the reflected laser radiation 260 is detected on-board the weapon 250 to guide the weapon 250 to the target 255, as set forth in the box 215; a determination is made such that if the detected laser radiation 260 originating from the first source 275 falls below a predetermined level, as set forth in the box 220, a second laser beam 265 from a second source (show in FIGS. 1–3) is generated as set forth in the box 225; the second laser beam 265 is reflected off the target 255, as set forth in the box 230; and the reflected laser radiation 267 originating from the second laser beam 265 is detected on-board the weapon 250 to guide the weapon 250 to the target 255, as set forth in the box 235.

All of the methods and apparatus disclosed and claimed herein can be made and executed without undue experimentation in light of the present disclosure. While the apparatus and methods of this invention have been described as a specific embodiment, it will be apparent to those of skill in the art that variations may be applied to the structures and in the steps or in the sequence of steps of the methods described herein without departing from the concept, spirit and scope of the invention. All such similar variations apparent to those skilled in the art are deemed to be within this spirit, scope and concept of the invention as defined by the appended claims.

What is claimed is:

1. An on-board weapon guidance system comprising:

(a) a laser light source;

(b) means for detecting radiation proceeding from a target to guide the weapon to the target; and (c) means for switching between: i) the detection of radiation originating from a source independent of the weapon and proceeding from the target, and ii) the detection of laser radiation originating from the laser light source and reflected from the target.

2. The system of claim 1 wherein the means for detecting comprises an optical assembly adapted to redirect the radiation to one of a quadrant detector or a LADAR receiver.

3. The system of claim 1 wherein the switching means switches from the detection of radiation originating from the independent source to the detection of reflected laser radiation originating from the laser light source if the detected radiation originating from the independent source falls below a predetermined level.

4. The system of claim 1 further comprising means for scanning a field with at least one laser beam originating from the laser light source.

5. The system of claim 4 wherein the scanning means is adapted to generate an image from the scanned field.

6. The system of claim 5 wherein the generated image is a three dimensional image.

7. The system of claim 6 wherein the generated image is used to identify a target within the field.

8. The system of claim 1 wherein the means for switching comprises a moveable mirror.

9. The system of claim 8 further comprising a torque motor to move the mirror.

10. The system of claim 8 further comprising a sensor adapted to determine the angular position of the mirror about an axis.

11. A dual mode seeker operable in a semi-active laser (SAL) mode and a laser radar (LADAR) mode, comprising:

(a) a laser light source;

(b) a first optical assembly adapted to receive radiation generated by a source independent of the seeker;

(c) a second optical assembly adapted to receive laser radiation generated by the laser light source and reflected from a target; and (d) a mirror adapted to redirect the received radiation to the first or second optical assembly.

12. The seeker of claim 11 wherein the radiation generated by a source independent of the seeker is laser radiation reflected from a target.

13. The seeker of claim 11 wherein the mirror is adapted to scan the target with laser light generated from the light source if the radiation detected by the first optical assembly falls below a predetermined level.

14. The seeker of claim 13 wherein the laser light source is adapted to generate an image from the scanned target.

15. The seeker of claim 14 wherein the generated image is a three dimensional image.

16. The seeker of claim 15 wherein the generated image is used to identify the target class.

17. The seeker of claim 11 wherein the mirror redirects all of the received radiation to the first or second optical assembly.

18. The seeker of claim 11 wherein the mirror is moveable from a first position to a second position.

19. The seeker of claim 18 further comprising a motor adapted to move the mirror between the first and second position.

20. The seeker of claim 19 wherein the mirror is adapted to scan a field with at least one laser beam originating from the laser light source when the mirror is in the second position.

21. The seeker of claim 19 wherein the mirror is held in the first position by a mechanical stop and a force applied by the motor.

22. The seeker of claim 18 wherein the mirror redirects the received radiation to the first optical assembly when the mirror is in the first position.

23. The seeker of claim 18 wherein the mirror redirects the received radiation to the second optical assembly when the mirror is in the second position.

24. In an optical seeker used for guiding a weapon to a target, having a laser source for generating laser light and scanning the target with laser energy and an optical package for detecting radiation, the improvement comprising:

means for switching between: i) the detection of radiation originating from a source independent of the seeker, and ii) the detection of reflected laser radiation originating from the laser source.

25. The improved optical seeker of claim 24 wherein the laser light source is adapted to generate an image from the scanned target.

26. The improved optical seeker of claim 25 wherein the generated image is a three dimensional image.

27. The improved optical seeker of claim 24 wherein the means for switching includes a mirror adapted to redirect the detected radiation.

28. The improved optical seeker of claim 27 further comprising first and second optical assemblies adapted to receive the redirected radiation.

29. The improved optical seeker of claim 27 further comprising a motor adapted to move the mirror.

30. The improved optical seeker of claim 26 wherein the means for switching is adapted to switch from the detection of radiation originating from the independent source to the detection of reflected laser radiation originating from the laser source when the detected radiation originating from the independent source falls below a predetermined level.

31. A method for guiding a weapon to a target comprising:

(a) receiving radiation from the target;

(b) tracking the radiation to guide the weapon to the target; and (c) monitoring the radiation such that if the radiation falls below a predetermined level a laser system on-board the weapon continues guiding the weapon comprising:

(i) generating a laser beam;

(ii) reflecting the laser beam off the target;

(iii) receiving laser radiation reflected from the target; and (iv) tracking the radiation to guide the weapon to the target.

32. The method as set forth in claim 31 wherein the radiation received from the target in step (a) is laser radiation reflected from the target.

33. The method as set forth in claim 31 wherein tracking the radiation in step (c)(iv) comprises tracking an image of the target generated from the received laser radiation.

34. The method as set forth in claim 33 further comprising identifying the target class from the generated image.

35. A method for guiding a weapon to a target comprising:

(a) generating a first laser beam directed to a target from a first source, the first source being located independently of the weapon;

(b) detecting the first laser beam aboard the weapon upon a reflection of the first laser beam from the target;

(c) guiding the weapon to the target responsive to the reflected first laser beam;

(d) generating a second laser beam directed to the target from a second source, the second source located aboard the weapon, upon determining that the reflected first laser beam has fallen below a predetermined level;

(e) detecting the second laser beam aboard the weapon upon a reflection of the second laser beam from the target; and (f) guiding the weapon to the target responsive to the reflected second laser beam.

36. The method as set forth in claim 35 further comprising generating an image of the target from the detected laser radiation of step (c) or (g).

37. The method as set forth in claim 36 further comprising identifying the target class from the generated image.

38. The method as set forth in claim 35 wherein generating the first laser beam comprises generating the beam from a source independent of the weapon.

39. The method as set forth in claim 35 wherein generating the second laser beam comprises generating the beam from a source on-board the weapon.

40. The method as set forth in claim 35 wherein generating the first laser beam comprises generating the beam from a source on-board the weapon.

41. The method as set forth in claim 35 wherein generating the second laser beam comprises generating the beam from a source independent of the weapon.

42. An on-board weapon guidance system comprising:

(d) a laser light source;

(e) means for detecting radiation proceeding from a target to guide the weapon to the target; and (f) means for switching between: i) the detection of radiation originating from a source independent of the weapon and proceeding from the target, and ii) the detection of laser radiation originating from the laser light source and reflected from the target, the means for switching including a moveable mirror.

43. The system of claim 42 wherein the means for detecting comprises an optical assembly adapted to redirect the radiation to one of a quadrant detector or a LADAR receiver.

44. The system of claim 42 wherein the switching means switches from the detection of radiation originating from the independent source to the detection of reflected laser radiation originating from the laser light source if the detected radiation originating from the independent source falls below a predetermined level.

45. The system of claim 42 further comprising means for scanning a field with at least one laser beam originating from the laser light source.

46. The system of claim 45 wherein the scanning means is adapted to generate an image from the scanned field.

47. The system of claim 46 wherein the generated image is a three dimensional image.

48. The system of claim 47 wherein the generated image is used to identify a target within the field.

49. The system of claim 42 further comprising a torque motor to move the mirror.

50. The system of claim 42 further comprising a sensor adapted to determine the angular position of the mirror about an axis.

* * * * *

UNITED STATES PATENT AND TRADEMARK OFFICE

CERTIFICATE OF CORRECTION

PATENT NO. : 6,262,800 B1
DATED : July 17, 2001
INVENTOR(S) : Lewis G. Minor

It is certified that error appears in the above-identified patent and that said Letters Patent is hereby corrected as shown below:

Delete claim 32.

Signed and Sealed this

Twelfth Day of March, 2002

*Attest:*

*Attesting Officer*

JAMES E. ROGAN
*Director of the United States Patent and Trademark Office*